United States Patent [19]

Heimberger

[11] 4,137,733

[45] * Feb. 6, 1979

[54] SLIDE-FASTENER-STRINGER HALF WITH KNITTED-IN COUPLING ELEMENTS AND METHOD OF MAKING SAME

[75] Inventor: Helmut Heimberger, Locarno, Switzerland

[73] Assignee: Optilon W. Erich Heilmann GmbH, Cham, Switzerland

[ * ] Notice: The portion of the term of this patent subsequent to Feb. 28, 1995, has been disclaimed.

[21] Appl. No.: 803,312

[22] Filed: Jun. 3, 1977

Related U.S. Application Data

[63] Continuation-in-part of Ser. No. 728,034, Sep. 30, 1976, Pat. No. 4,075,874.

[30] Foreign Application Priority Data

May 20, 1976 [DE] Fed. Rep. of Germany ..... 2622529

[51] Int. Cl.[2] ..... D04B 21/00; A44B 19/34

[52] U.S. Cl. ..... 66/195; 24/205.16 R; 66/203

[58] Field of Search ..... 66/203, 190, 192, 193, 66/195; 24/205.16

[56] References Cited

U.S. PATENT DOCUMENTS

| | | | |
|---|---|---|---|
| 3,442,099 | 3/1969 | Auville et al. | 66/195 X |
| 3,651,666 | 3/1972 | Austin et al. | 66/207 |
| 3,864,945 | 2/1975 | Frohlich | 66/193 |
| 3,881,326 | 5/1975 | Bourgeois | 66/195 |
| 4,014,190 | 3/1977 | Terada et al. | 66/195 |

FOREIGN PATENT DOCUMENTS

| | | | |
|---|---|---|---|
| 1434760 | 5/1976 | United Kingdom | 66/195 |

*Primary Examiner*—Ronald Feldbaum
*Attorney, Agent, or Firm*—Karl F. Ross

[57] ABSTRACT

A slide-fastener stringer half comprises a knit tape having a plurality of parallel longitudinally extending wales and a plurality of transversely extending courses, and a monofilamentary coupling element on the tape and having a succession of turns each having a pair of shanks and a coupling head joining the shanks and projecting transversely beyond the longitudinal edge of the tape. The shanks of each turn lie at least in regions adjacent the respective head in a plane generally perpendicular to the tape. The tape comprises at least one warp yarn forming a chain knitted into the tape at every other course and overlying the shanks at the regions adjacent the heads. Thus the shanks are laid into the chains at these regions so that the coupling element is thoroughly integrated into the knit of the tape. The tape itself may be formed of a full-tricot ground. Alternatively the tape can be formed of second weft yarns having open loops at each course and extending transversely each over two respective wales. The warp yarn, as it overbridges each other course, is briefly pulled tight to produce fold-like seats in the ground unit to receive the paired shanks.

7 Claims, 7 Drawing Figures

FIG. IA

SLIDE-FASTENER-STRINGER HALF WITH KNITTED-IN COUPLING ELEMENTS AND METHOD OF MAKING SAME

CROSS-REFERENCE TO RELATED APPLICATIONS

This application is a continuation-in-part of Ser. No. 728,034 filed Sept. 30, 1976 (U.S. Pat. No. 4,075,874) which, in turn, is related to the following copending applications.

Ser. No. 728,136 filed Sept. 30, 1976 (now abandoned),
Ser. No. 728,032 filed Sept. 30, 1976 (now U.S. Pat. No. 4,064,602),
Ser. No. 728,134 filed Sept. 30, 1976 (now abandoned),
Ser. No. 728,033 filed Sept. 30, 1976,
Ser. No. 728,135 filed Sept. 30, 1976 (now abandoned),
Ser. No. 728,133 filed Sept. 30, 1976 (U.S. Pat. No. 4,043,007),
Ser. No. 728,035 filed Sept. 30, 1976 (now abandoned),
Ser. No. 728,031 filed Sept. 30, 1976 (now U.S. Pat. No. 4,067,208), and
Ser. No. 728,132 filed Sept. 30, 1976. (U.S. Pat. No. 4,051,579)

FIELD OF THE INVENTION

The present invention relates to a slide-fastener stringer half and method of making same. More particularly, this invention concerns such a stringer half wherein a monofilamentary coupling element is knitted directly into the supporting tape.

BACKGROUND OF THE INVENTION

A slide-fastener stringer half is known having a coupling element formed as a synthetic-resin monofilament with a longitudinal succession of turns each having a pair of shanks connected together by a coupling head, with one of the shanks of each turn connected via a bight to a shank of an adjoining turn. It is known to lay these shanks directly into a knit support tape so that the coupling element itself forms part of the knit and stitching is not necessary to secure the stringer half together. In such an arrangement the coupling head extends laterally beyond one of the longitudinal edges of the support tape (see Japanese patent JA-PS 38-11 673).

In some arrangements the two shanks of each turn are knitted into adjacent but succeeding and separate courses of the knitted support tape. The coupling heads joining the two shanks of each turn project laterally from a longitudinal edge of the tape and lie in a plane which extends generally perpendicular to the tape. This perpendicular position is necessary in order to prevent the slide fastener formed with such a stringer from opening accidently (see German open application DT-OS No. 22 21 325).

It has also been suggested to knit both of the shanks into a single course. This makes the manufacture of the coupling tape extremely difficult with conventional warp-knitting machines. Complicated control mechanisms are invariably required. The main difficulty is that when a coupling element made from a synthetic-resin monofilament of normally around 0.5 mm diameter is knitted into the tape it is not possible readily to conform the course locations to the gauge (head spacing) of the coupling element so that such a coupling-element coil can be knitted into each course.

OBJECTS OF THE INVENTION

It is an object of the present invention to improve upon the system described in patent application Ser. No. 728,034 filed Sept. 30, 1976 (U.S. Pat. No. 4,075,874).

It is also an object of the present invention to provide an improved slide-fastener stringer half and method of making same.

Another object is the provision of such a stringer half into which the coupling element is integrally knitted, yet which overcomes the above-given disadvantages.

Yet another object of the invention is to provide such a coupling element whose coupling heads lie in a plane generally perpendicular to the tape, but which is advantageously laid into the knitted tape and which can be produced by means of conventional knitting machinery.

Another object is to provide a knitted-tape stringer which can withstand all of the stresses which arise in use and which nevertheless has its coupling memners or eyes lying substantially in planes perpendicular to the plane of the tape.

SUMMARY OF THE INVENTION

These objects are attained according to the present invention in a slide-fastener stringer half of the above-described general type wherein the two shanks of each turn lie at least adjacent their coupling heads in a respective plane generally perpendicular to the support tape, that is lie one over the other relative to the support tape, and wherein the tape is formed in part of at least one chain-forming or pillar-forming warp yarn which is knitted into the tape only in every other course and overlies the two shanks of a respective turn in between each knitted-in location.

Thus it is possible to use a support tape of very compact structure, that is of very fine gauge, since the spacing between adjoining turns of the coupling element is twice the distance between adjoining courses. Such a slide-fastener stringer half can readily be made on conventional warp-knitting machinery.

According to a further feature of this invention the underlying ground knit of the tape is a full tricot. It is also within the scope of this invention to form the ground knit not as a tricot but as a warp knit with a plurality of warp yarns each forming a pillar or chain having an open loop at each course and extending each over two wales. Such a tape can readily be made on conventional knitting machinery with no modification whatsoever.

Furthermore a tape of extremely good longitudinal and transverse dimensional stability is obtained while the stringer half so manufactured is exceptionally durable. What is more, the alignment of each of the coupling heads in a plane generally perpendicular to the plane of the tape makes a slide-fastener stringer which is extremely unlikely to open inadvertently or accidentally in use, as the coupling heads of adjoining halves can join so securely together that they can only be separated by means of the slider.

In accordance with yet another feature of this invention after knitting-together of the tape as described above the warp yarns at least are shrunk. This tends to pull the tape tightly into contact with the underside of the slide fastener and make the entire half an absolute unified and virtually integral assembly.

It is possible to, in accordance with this invention, extend the tape transversely away from the coupling element. In such an arrangement the warp chains that secure the coupling element in place need not be provided in that portion of the tape free of the coupling element. It is another feature of this invention, however, to form a so-called strip slide-fastener stringer, wherein the coupling element extends the full transverse width of the support tape so that the heads project along one edge of the bights along the other. Thus the warp yarns that secure the coupling element into the tape, like needle threads of conventional double chain or lock stitching extend across the full width of the tape. In this last-mentioned arrangement the integration of the coupling element into the tape is extremely good so that a dimensionally very stable slide-fastener stringer half is obtained from which it is virtually impossible to withdraw the coupling element.

Strip-type slide fasteners are described, for example, in German published application DT-AS No. 11 71 659 (FIG. 1).

A slide-fastener spring half is made in accordance with this invention on a knitting machine having first and second guide bars which are used to form the ground knit, e.g. the above-mentioned full tricot, and an end guide bar which serves to form the warp chain in every second course, blind-lapping in the intervening courses, so as to hold in the coupling element. This coupling element itself, which is already in generally helicoidal shape, is simply fed in through a groove in the machine so that it automatically is integrated into the tape. It is possible to tension the warp yarns very tightly so that they pull the tape into very close juxtaposition with the coupling element, indeed forcing it into the spaces between adjoining turns. This insures that the assembly will be almost an integral piece.

According to yet another feature of this invention two such slide-fastener stringer halves are made at the same time. During such manufacture the coupling heads of the two coupling elements are automatically interleaved, and the warp yarns are oppositely lapped in each of the coupling tapes. It is necessary in such an arrangement to provide separate guide vars for each of the warp yarns.

According to a feature of the invention, at the instant of the blind inlaying of the pairs of shanks, the thread tension of the warp yarns drawn over the shanks is briefly raised to draw the course bracketing the paired shanks into a fold-like configuration. The resulting folds or channels thus receive the paired shanks of each head.

BRIEF DESCRIPTION OF THE DRAWING

The above and other objects, features and advantages of the present invention will become more readily apparent from the following description, reference being made to the accompanying drawing in which:

FIG. 1A is a diagrammatic section along line IA—IA of FIG. 1;

SPECIFIC DESCRIPTION

Figure 1:
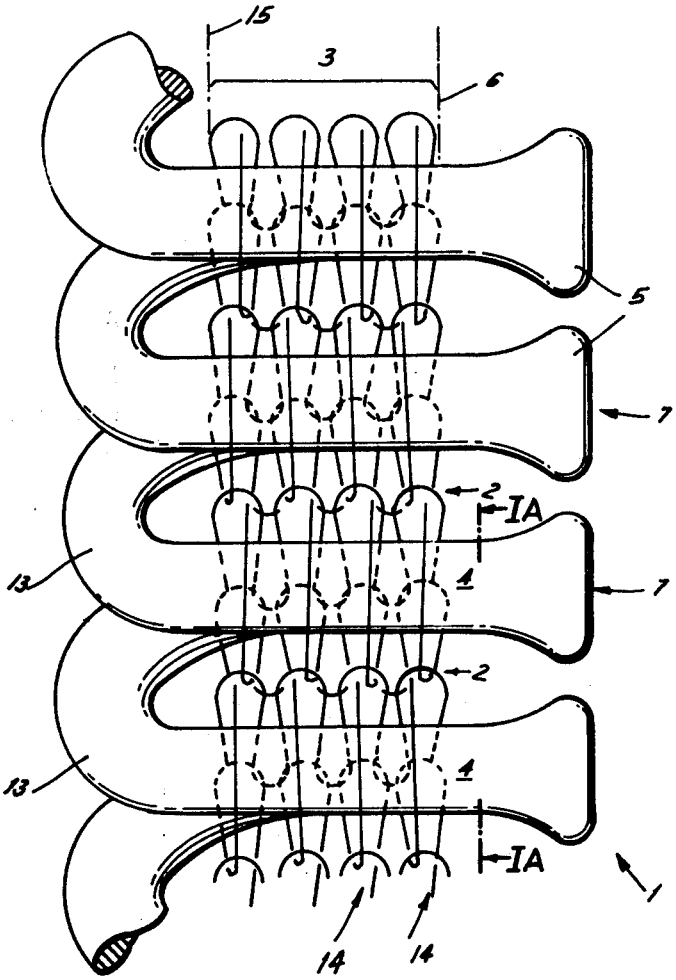
FIG. 1 is a large-scale top diagrammatic view of a portion of a slide-fastener stringer half according to the invention.

As shown in FIG. 1 a slide-fastener stringer half has a helicoidal coupling element 1 and a knit tape 3 having a longitudinal succession of transversely extending courses 2 and a plurality, here four, of parallel longitudinally extending wales 14. The coupling element 1 is a synthetic-resin monofilament formed with a longitudinal succession of turns 7 each in turn having a pair of parallel shanks 4 lying in a plane perpendicular to the longitudinal axis of the arrangement and perpendicular to the tape.

The warp chains are of the single-bar or single-needle type, i.e. each wale is a single warp chain so that valleys are defined between the wales. The warp chains are not interconnected, the sole connection between them being the laid-in weft.

These shanks 4 extend beyond a longitudinal edge 6 of the tape and are interconnected at their ends beyond this edge 6 by means of coupling heads 5 which each are flattened and lie in the plane of the respective shanks. At their rear ends the shanks 4 extend beyond the opposite edge 15 of the tape 3 and each upper shanks 4 is connected via a bight 13 to the lower shank 4 of an adjoining turn 7. Thus the arrangement is a so-called strip fastener.

Figure 2A:
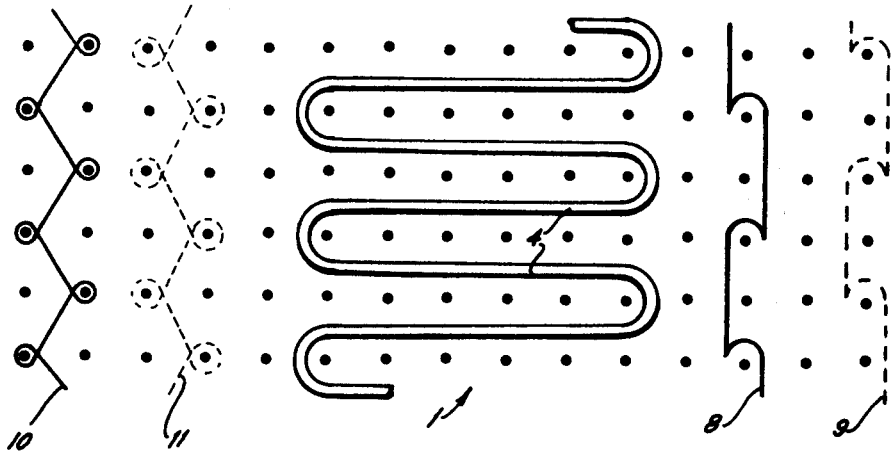
FIG. 2A is a point-paper diagram illustrating the knit of the tapes of the stringer halves of FIG. 2.
Figure 2:
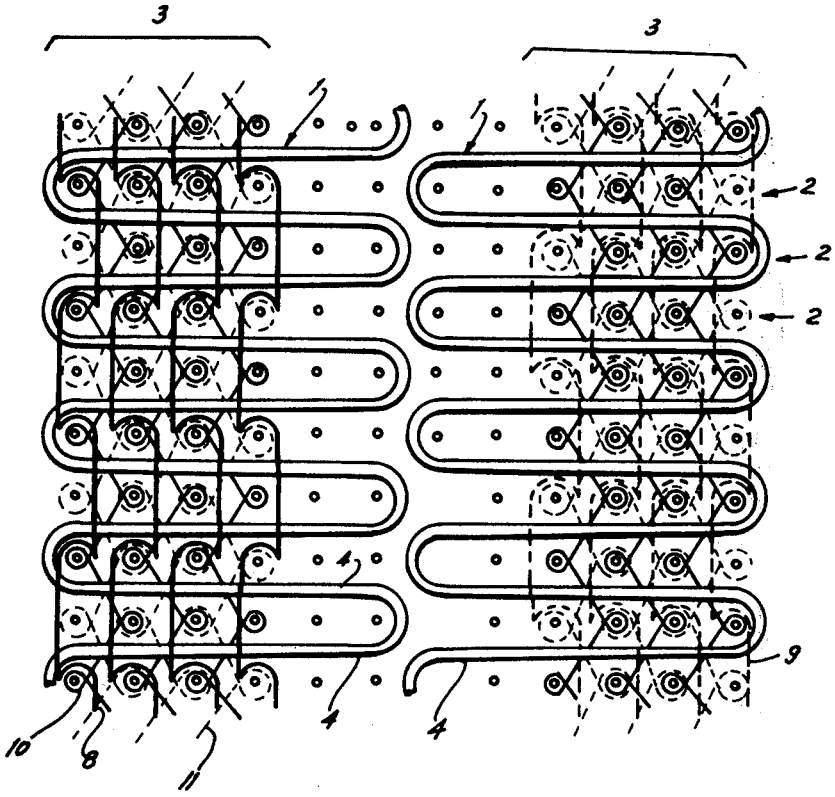
FIG. 2 is a large-scale diagrammatic view showing a stringer with two halves such as shown in FIG. 1.
Figure 3A:
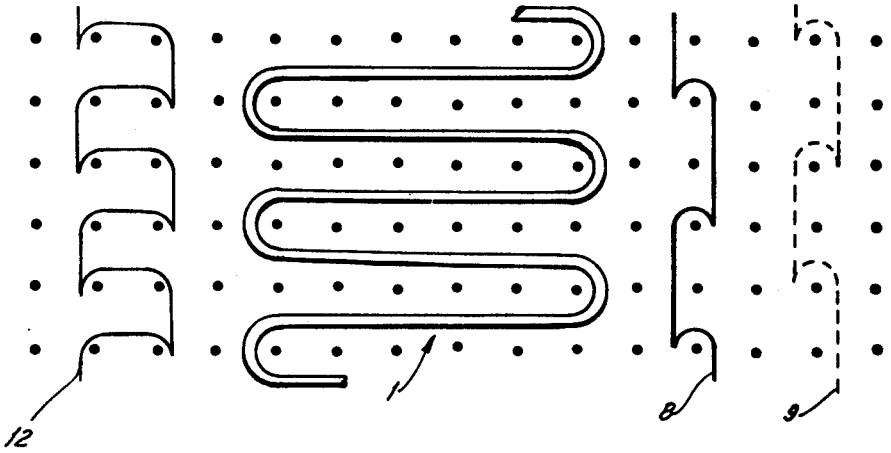
FIGS. 3 and 3A are views similar to FIGS. 2 and 2A showing another arrangement in accordance with the present invention.
Figure 3:
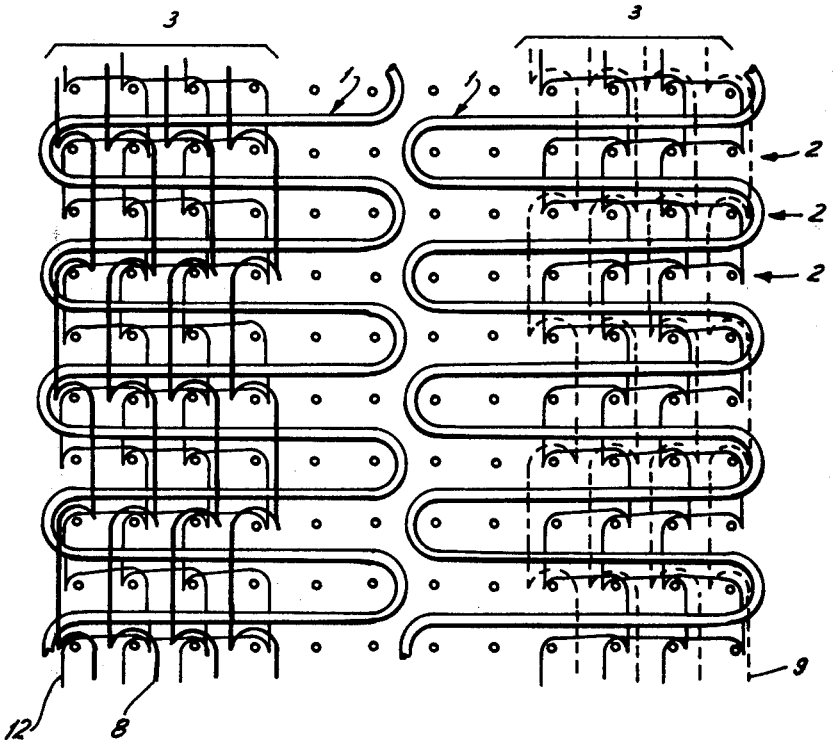

As better shown in FIGS. 2 and 2A the tape 3 is made up of a full-tricot ground (double tricot) knit constituted by lapped yarns 10 and 11. The coupling element lies on top of the ground knit formed by these yarns 10 and 11 and is secured thereto by means of warp filaments 8 or 9 each of which form an open loop pillar or chain only knitted into the tape at every other course 2.

It is noted that the views of FIGS. 2 and 2A of the pattern show the shanks 4 next to each other, whereas in reality they lie directly over each other. Thus as best shown in FIG. 2 two tapes 3 are formed simultaneously, one for using four warp yarns 8 and one using four warp yarns 9, but both having the full-tricot ground formed of the filaments 10 and 11. When the tapes are knitted the coupling elements 1 are laid into them as a weft with their coupling heads 5 interleaved. Similarly it is noted that the two shanks 4 of each turn are aligned over every other course 2, leaving exposed the course 2 into which the securing warp yarn chains 9 are knitted.

As can be seen from FIG. 1A, when the warp yarns 22 overlying the paired shanks 4*a*, 4*b*, are briefly tensioned during the blind inlaying of these shanks, the ground knit 21 on opposite sides of the shanks is drawn together to form fold-like channels 20 in which the shanks 4*a* and 4*b* rest.

Thus the tape shown in FIGS. 2 and 2A is knitted with the following pattern:

coupling element 1—6-6/0-0,
element-security warp yarn 8—2-2/2-0/0-0/0-2,
element-security warp yarn 9—0-2/0-0/2-0/2-2,
tricot yarn 10—1-0/1-2, and
tricot yarn 11—1-2/1-0.

It is noted that the chain 8 is only knitted in every other course, and that the yarns 10 and 11 are lapped against each other. The element 1 is also preformed into the desired helicoidal shape so that it automatically falls in the desired position. Furthermore it is noted that the tape embodying the warp yarns 9 are identical to that shown in FIG. 1, except that the yarn 9 is oppositely lapped to the yarn 8 and in alternate courses so that the two elements 1 can mesh properly.

The knit shown in 3 and 3A is identical to that shown in FIGS. 2 and 2A, except that the ground knit is formed of warp filaments 12 forming open-loop warp chains each extending over two wales 14, with loops at each course 2. Thus the warp yarn 12 is patterned 2-0/0-2.

Figure 4:
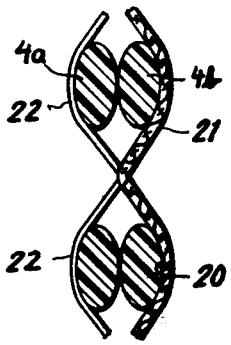
FIG. 4 is a view similar to FIG. 1 of another stringer half.
Figure 4:
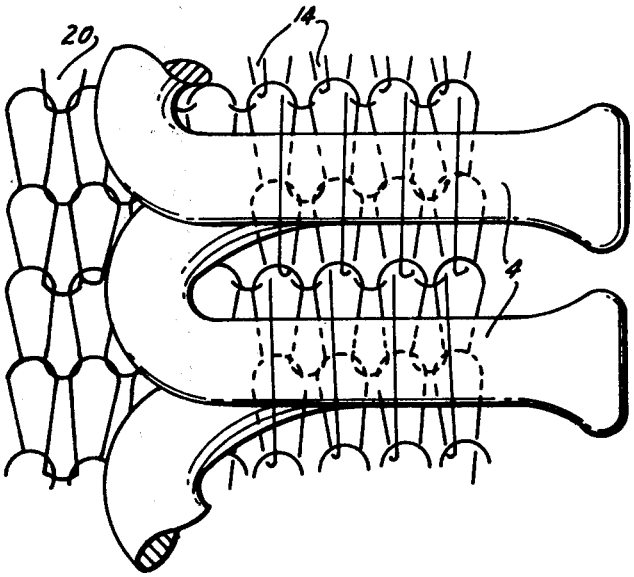

FIG. 4 shows an arrangement similar to FIG. 1 but in which the knit extends at 20 beyond the rear of the coupling element and here is free from the attachment warp chains 8 or 9 but can be formed by the warp 12 of the tricot knit 10, 11.

The slide-fastener stringer half according to this invention has extremely good dimensional stability. It can be produced on a conventional warp-knitting machine, and the coupling element is so thoroughly integrated into the tape that separation of the two is virtually impossible. Furthermore since the coupling heads are aligned in the most desirable position a slide fastener can be produced from such a stringer half which is extremely strong and unlikely to pull apart in use.

I claim:

1. A slide-fastener stringer half comprising a knit tape comprising a full-tricot ground knit and having a plurality of parallel longitudinally extending wales and a plurality of transversely extending courses, and a monofilamentary coupling element on said tape and having a succession of turns each having a pair of shanks and a coupling head joining said shanks and projecting transversely beyond a longitudinal edge of said tape, said shanks of each turn lying at least in a region adjacent said head in a plane generally perpendicular to said tape, said tape comprising at least one warp yarn forming a chain knitted into said tape only at every other course and overlying said shanks at said regions, whereby said shanks are laid onto said tape and into said chain at said regions, said warp yarn being tensioned to draw the tape into fold-like channels receiving each pair of shanks.

2. The stringer half defined in claim 1 wherein said tape comprises a plurality of second warp yarns forming respective chains having loops at each course and each extending over two respective wales.

3. The stringer half defined in claim 1 wherein the shanks of said turn lie entirely in the respective plane and said turns each have a connecting bight connecting it on one longitudinal side to the adjoining turn and lying at the other longitudinal edge of said tape, said tape having a plurality of such warp yarns and being of a transverse width smaller than said coupling element.

4. A method of making a slide-fastener stringer half comprising the steps of simultaneously and concomitantly:

forming a knitted tape as a full tricot having a plurality of longitudinally extending parallel wales and a plurality of transversely extending parallel courses;

laying into said tape at every other course the two shanks of a turn of a monofilamentary coupling element each of whose turns has two such shanks joined by a coupling head;

orienting said coupling head to extend beyond a longitudinal edge of said tape;

chaining at least one warp yarn into said tape in a chain overlying said shanks and knitted into said tape at every other course; and briefly increasing the tension of said warp yarn at each laying in of a pair of shanks to draw portions of the tape together on opposite sides of each shank pair, whereby forming a fold-like channel receiving each shank pair.

5. The method defined in claim 4 wherein said tape is knit of a plurality of second warp yarns forming warp chains having loops at each course and extending transversely over two respective wales.

6. The method defined in claim 4, further comprising the step of shrinking said warp yarn after chaining of same over said coupling element.

7. The method defined in claim 4 wherein two such halves are formed simultaneously, said method further comprising the step of interleaving coupling heads of said elements extending between the two shanks of each turn, said warp yarns being oppositely knit in each tape.

* * * * *